US005318220A

United States Patent [19]

Gagliardo

[11] Patent Number: 5,318,220

[45] Date of Patent: Jun. 7, 1994

[54] CARTON WITH A SELF-LOCKING END CLOSURE

[75] Inventor: Jesse F. Gagliardo, Lisle, Ill.

[73] Assignee: Gaylord Container Corporation, Deerfield, Ill.

[21] Appl. No.: 977,586

[22] Filed: Nov. 17, 1992

[51] Int. Cl.[5] ..... B65D 5/10

[52] U.S. Cl. ..... 229/157; 229/156; 229/185

[58] Field of Search ..... 229/156, 157, 185

[56] References Cited

U.S. PATENT DOCUMENTS

| | | | |
|---|---|---|---|
| 490,167 | 1/1893 | Schmidt . | |
| 2,053,857 | 9/1936 | Weiss | 229/185 |
| 2,663,491 | 12/1953 | Hill et al. | 229/157 |
| 2,713,454 | 7/1955 | Nute et al. . | |
| 2,747,788 | 5/1981 | Tilly . | |
| 4,279,377 | 7/1981 | Peeples et al. | 229/185 |
| 4,279,379 | 7/1981 | Lohrbach et al. . | |
| 4,347,970 | 9/1982 | Nardone | 229/156 |
| 4,583,678 | 4/1986 | Weimer, Jr. | 229/185 |
| 4,650,112 | 3/1987 | Booth | 229/157 |
| 4,702,408 | 10/1987 | Powlenko . | |
| 4,821,949 | 4/1989 | Booth | 229/156 |
| 4,884,741 | 12/1989 | Nederveld . | |
| 5,022,582 | 6/1991 | Ritter | 229/185 |
| 5,046,662 | 9/1991 | Cowles . | |
| 5,104,035 | 4/1992 | Rosenbaum, II . | |
| 5,139,196 | 8/1992 | Fry et al. | 229/185 |

*Primary Examiner*—Gary E. Elkins
*Attorney, Agent, or Firm*—Jenner & Block

[57] ABSTRACT

A carton with a self-locking end closure includes a pair of end flaps connected by fold lines to end walls, and a pair of side flaps connected by fold lines to sidewalls. The end flaps have tapered or notched side edges and an outer edge. The outer edge of each end flap includes two symmetrically positioned notches. Each end flap also includes a pair of locking tabs. The side flaps include a pair of side edges and an outer edge and a pair of hinged locking devices which are symmetrically positioned at predetermined distances from the outer edges. The locking devices include an ear or flap, a cut line defining the ear or flap, a hinge line along which the ear or flap rotates, and a tab adjacent the ear. The end flaps are foldable against the side flaps, permitting the locking tabs of the end flaps to engage the locking devices of the side flaps to lock the end closure of the carton.

32 Claims, 5 Drawing Sheets

CARTON WITH A SELF-LOCKING END CLOSURE

FIELD OF THE INVENTION

This invention relates generally to containers such as folding cartons and corrugated paper-product boxes, and in particular to cartons and boxes having self-locking end closures.

BACKGROUND OF THE INVENTION

Cartons are used in a variety of industries, for example, the food industry. Cartons which may be collapsed or knocked-down are especially desirable as they may be shipped or stored in a flat configuration, thereby minimizing the amount of storage space used. Cartons which are reusable after being disassembled or knocked-down reduce both the waste and expense associated with the manufacture of new or replacement cartons.

Some cartons are assembled using glue, staples or stitching to secure the bottom flaps. U.S. Pat. Nos. 2,713,454 and 2,747,788, for example, disclose cartons which close or secure the bottom flaps with glue or other adhesive materials. The glued flaps form a strong and durable seal. However, the glue also makes disassembly and reuse of the cartons difficult, if not impossible. Moreover, repeated disengagement of glued or otherwise secured bottom flaps from each other weakens the integrity of the flaps and shortens the useful life of the carton.

Other cartons utilize tabs and slots on end and side flaps to close and secure the bottoms and tops of the cartons. For example, U.S. Pat. Nos. 490,167 and 4,884,741 disclose cartons with top and bottom closures which are secured by inserting tabs on end flaps into slots on adjacent side flaps, and U.S. Pat. Nos. 4,279,379 and 4,702,408 disclose cartons with bottom flaps or panels which are locked by pushing tabs into slots to join end flaps and side flaps together. Such cartons may be disassembled and reused. However, when products or articles are placed in such cartons, the products can inadvertently disengage the inserted tabs from the slots at the bottom of the carton, thereby weakening or eliminating the bottom closure. In addition, the tabs may bend or their rigidity may be diminished by repeated assembly or disassembly of the carton.

Still other cartons, for example, U.S. Pat. Nos 5,046,662, 5,104,035 and 4,884,741 disclose self-locking cartons which utilize flaps containing fold lines and locking recesses or slots, to interlock with tabs. A fold on an end flap which parallels the outer edge of the flap permits the flap to be folded in an outwardly direction, away from the carton interior. The folding effectively shortens the end flap, thereby making it easier to insert the tabs of the end flap into the slots or locking recesses of adjacent side flaps. If locking recesses are used instead of slots, they shield the tabs in the interior of the carton and help to prevent inadvertent disengagement of the tabs. However, conventional end flap fold lines create other problems. For example, because the fold lines are biased outwardly, away from the interior of the carton, the fold lines increase the likelihood that the tabs will inadvertently disengage from the slots or locking recesses. Also, assembling and disassembling the closures of such cartons require several steps.

A need, therefore, exists for a reusable carton with a strong and positive self-locking bottom closure which is easy to lock and unlock and is not susceptible to inadvertent opening or disengagement.

SUMMARY OF THE INVENTION

It is an object of this invention to provide a reusable, self-locking carton which is easily assembled and disassembled with a minimum of materials and labor.

Another object of this invention is to provide a carton which may be stored and shipped in a substantially flat configuration.

Still another object of this invention is to provide a self-locking carton which does not require permanent bottom closing means, such as adhesives, for assembly into a box-like configuration.

Still another object of this invention is to provide a carton with a strong, self-locking bottom closure which is easy to lock and unlock with a minimum of steps.

Yet another object of this invention is to provide a self-locking carton bottom which cannot inadvertently be disassembled or disengaged.

A carton with a self-locking bottom closure in accordance with the invention includes a pair of opposed sidewalls connected at wall fold lines to a pair of opposed end walls, a pair of end flaps connected by end flap fold lines to the end walls, and a pair of side flaps connected by side flap fold lines to the sidewalls. The end and side flaps interlock to form a bottom closure for the carton. Each end flap includes a pair of tapered side edges and an outer edge which is generally parallel to the end flap fold line. The outer edge includes a pair of symmetrically positioned notches and sloped outer edge portions which are mirror images of each other. The sloped outer edge portions extend between each notch and the end of the side edges. The notch, the sloped outer edge portion and the end portion of the side edge extending towards the outer edge combine to define a locking tab. Each side flap has two opposed side edges and an outer edge generally parallel to the side flap fold line. Each side flap includes a pair of locking devices for securing the end flap locking tabs. The pair of locking devices are mirror images of each other and are symmetrically positioned at predetermined distances from the outer edge and side edges of the side flap. Each locking device includes a flap or an ear, a hinge line, a cut line and a projecting tab. The flap or ear is connected by the hinge line to the side flap and defined by the cut line extending from one end of the hinge line to the other end of the hinge line. The cut line has a plurality of segments, including a somewhat s-shaped segment which, in part, defines the projecting tab adjacent the ear. The ear is rotatable along the hinge line, thereby creating an opening in the side flap when the ear is rotated away from the side flap.

The carton is assembled by first placing the pair of sidewalls (and the pair of end walls) in opposing positions and inverting the carton to place the end and side flaps right side up. The side flaps are then folded inwardly toward a common plane which is substantially perpendicular to the sidewalls and end walls of the carton. At least one end flap is then rotated towards the same common plane and forced downwardly against the two side flaps. As the end flap is rotatably forced against the two side flaps, the side edges of the two locking tabs on the end flap make contact with the surface of the side flaps and cause the side flaps to rotate downwardly into the interior of the carton. As the side edges of the two locking tabs continue pushing the side flaps downwardly, the side edges begin sliding downwardly along the now sloped side flaps and towards the closest ears of the side flaps. As the side edges of the locking tabs continue sliding downwardly, portions of the side edges of the end flap pass over the ears without applying any force against the ears because the projecting tabs adjacent the ears contact and support the side edges of the locking tabs. The projecting tabs act as ramps for the side edges of the locking tabs which continue traveling downwardly until the side edges pass by the projecting tabs. Then the locking tab side edges push the ears away from the side flaps toward the inside of the carton, thereby forming openings in the side flaps through which the locking tabs move. Once this has occurred, downward force on the end flap can be released, thereby permitting the pair of side flaps and the end flap to spring outwardly and upwardly until projecting tabs on the two side flaps closest the end flap abut and interlock with the two locking tabs of the end flap. The other end flap is interlocked similarly with the opposing ends of the side flaps, either simultaneously with the first end flap or immediately after the first end flap has been interlocked.

The bottom flaps can just as easily be unlocked by applying force downwardly on at least one side flap, thereby causing the side flap to rotate downwardly into the interior of the carton. As the side flap is rotated downwardly, the projecting tabs of the side flap press against and push the adjacent locking tabs downwardly. As the downward force continues, the projecting tabs begin sliding along the surface of the locking tabs towards the side edges of the locking tabs. When the projecting tabs move past the side edges, the corresponding locking tabs of the side flaps are disengaged and the downward force on the side flaps can be released. The other side flap may be unlocked simultaneously or immediately thereafter in the same fashion.

DETAILED DESCRIPTION

Figure 1:
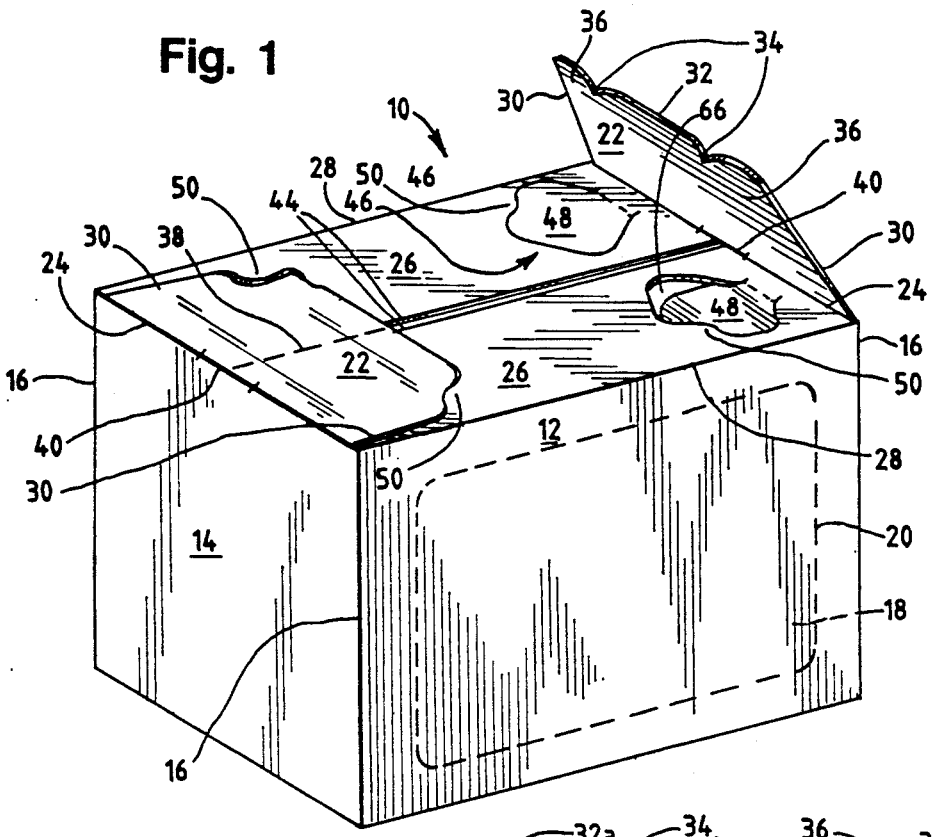
FIG. 1 is an inverted, perspective view of a carton with a partially assembled self-locking bottom closure according to the present invention.

Referring to FIG. 1, a carton 10 according to the present invention is shown in an inverted and perspective position such that the bottom of the carton can be viewed. Carton 10 is formed from a blank 80 which is described in detail later with reference to FIG. 9. Carton 10 has opposed sidewalls 12 and opposed ends walls 14. The sidewalls 12 and end walls 14 are joined together at wall fold lines 16. Sidewall 12 may include a punch-out area 18 defined by a perforated line 20. Punch-out area 18 can be removed from carton 10 to permit access to the contents of a fully assembled carton 10 or to display or reveal the contents of a fully assembled carton 10. Carton 10 may include other punch-out areas (not shown), for example, on the other sidewall or on one or both of the end walls. Carton 10 also may not have any punch-out areas.

The bottom closure of carton 10 includes a pair of end flaps 22 coupled by end flap fold lines 24 to end walls 14, and a pair of side flaps 26 coupled by side flap fold lines 28 to sidewalls 12. Each fold line 24 permits its corresponding end flap 22 to rotate about fold line 24. Similarly, each fold line 28 permits its corresponding side flap 26 to rotate about fold line 28.

Figure 2:
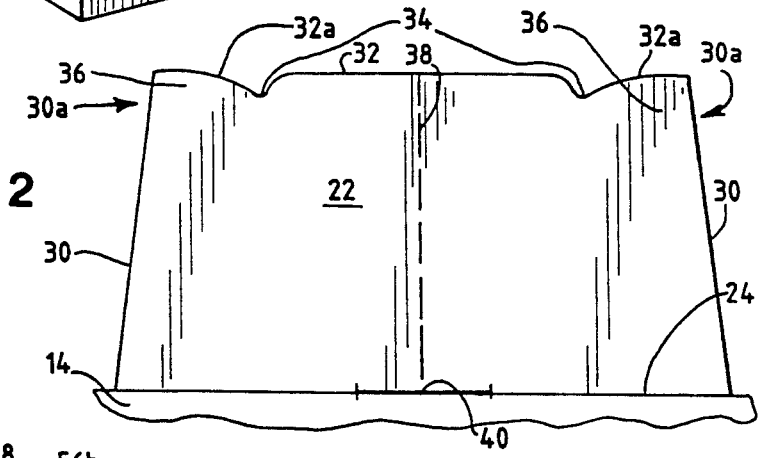
FIG. 2 is a fragmentary plan view of an end flap of the carton in FIG. 1.

Referring to FIGS. 1 and 2, each end flap 22 has a pair of inwardly tapered side edges 30 with end portions 30*a* and an outer edge 32 which is substantially parallel to fold line 24. Outer edge 32 includes a pair of mirror image notches 34 and sloped portions 32*a* which are symmetrically positioned relative to the end of tapered side edges 30. In a preferred embodiment, notches 34 are positioned along outer edge 32 at approximately one-fourth the width of the end flap 22. Sloped portions 32*a* extend between each notch 34 and the end of side edge 30. Notch 34, the sloped portion 32*a* and the end portion 30*a* form locking tab 36.

Each end flap 22 may also include a fold line 38 perpendicular to and extending between outer edge 32 and fold line 24 and substantially located at the middle of end flap 22. A slit 40 also may be included along fold line 24. In a preferred embodiment, slit 40 is positioned relative to fold line 38 such that fold line 38 bisects slit 40.

Figure 3:
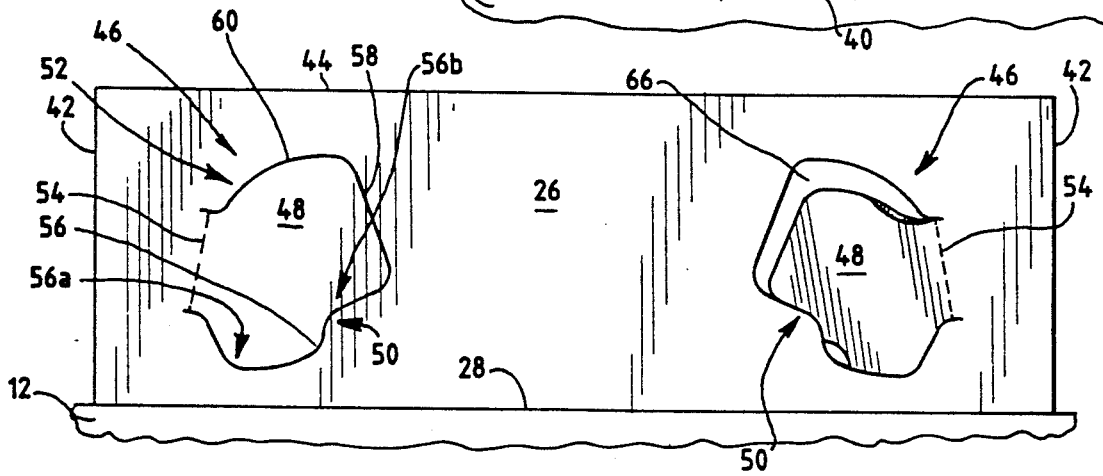
FIG. 3 is a fragmentary plan view of a side flap of the carton in FIG. 1.

Referring to FIGS. 1 and 3, each side flap 26 is generally rectangular and includes a pair of side edges 42 and an outer edge 44. Each side flap 26 has a pair of locking devices 46 symmetrically positioned as mirror images at predetermined distances from side edges 42 and outer edge 44. Each locking device 46 secures one end of a side flap 26 to a corresponding end of an end flap 22 when carton 10 is assembled, as shown, for example, on the left side of FIG. 1.

Figure 4A:
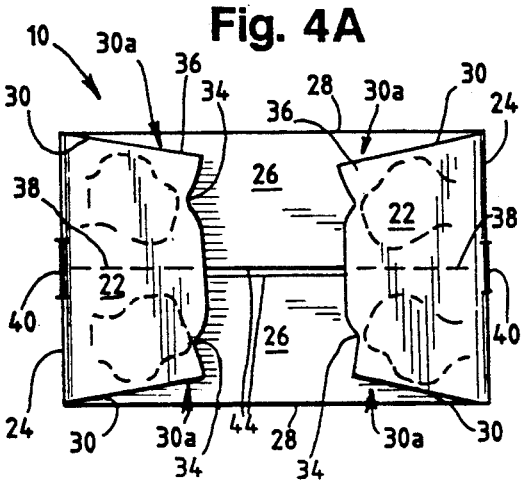
FIG. 4A is a plan view of the inverted carton in FIG. 1, illustrating assembly of the self-locking bottom closure with the side and end flaps folded inwardly toward a common plane substantially perpendicular to the sidewalls and end walls.
Figure 5:
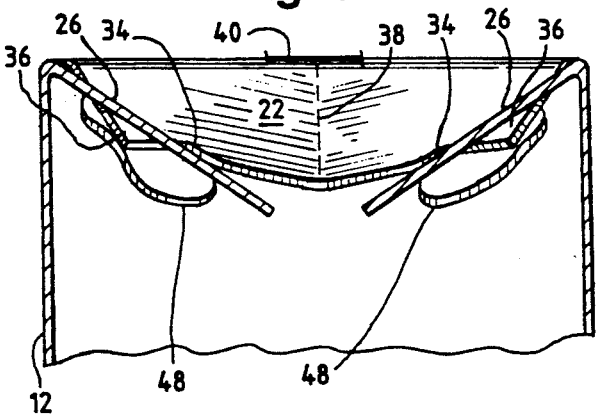
FIG. 5 is a fragmentary, cut away view along line 5—5 in FIG. 4B illustrating assembly of the self-locking bottom closure just after the locking tabs have engaged the locking devices.
Figure 6:
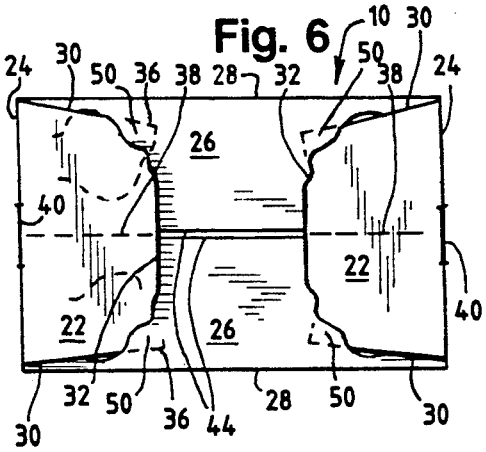
FIG. 6 is the same view of the inverted carton in FIGS. 4A and 4B illustrating the fully assembled self-locking bottom closure.

Each locking device 46 includes an ear or flap 48, a projecting tab 50, a cut line 52 and a hinge line 54. The boundary of each ear 48 is defined by cut line 52. Cut line 52 extends from and is connected to the two ends of hinge line 54, and ear 48 is rotatable about hinge line 54. As illustrated in FIGS. 1 and 3, when ear 48 rotates downwardly through side flap 26, an opening 66 is created in side flap 26. Projecting tab 50 is adjacent ear 48 and is defined by part of cut line 52. Each locking device 46, including ear 48, tab 50, cut line 52 and hinge line 54, cooperates with a corresponding locking tab 36 of an end flap 22 to form a self-locking bottom closure as shown in FIGS. 4–6.

Cut line 52 has a plurality of segments, including a generally s-shaped segment 56, a generally straight segment 58, and a generally curved segment 60. S-shaped segment 56 includes convex and concave portions **56*a* and 56*b* relative to side flap fold line 28. Convex portion 56*a* extends generally from one end of hinge 54 and connects with the concave portion 56*b*. Concave portion 56*b* defines the edge of projecting tab 50. Straight segment 58 extends from the concave portion 56*b* of segment 56 to curved segment 60 which is connected to the other end of hinge line 54**.

Figure 12:
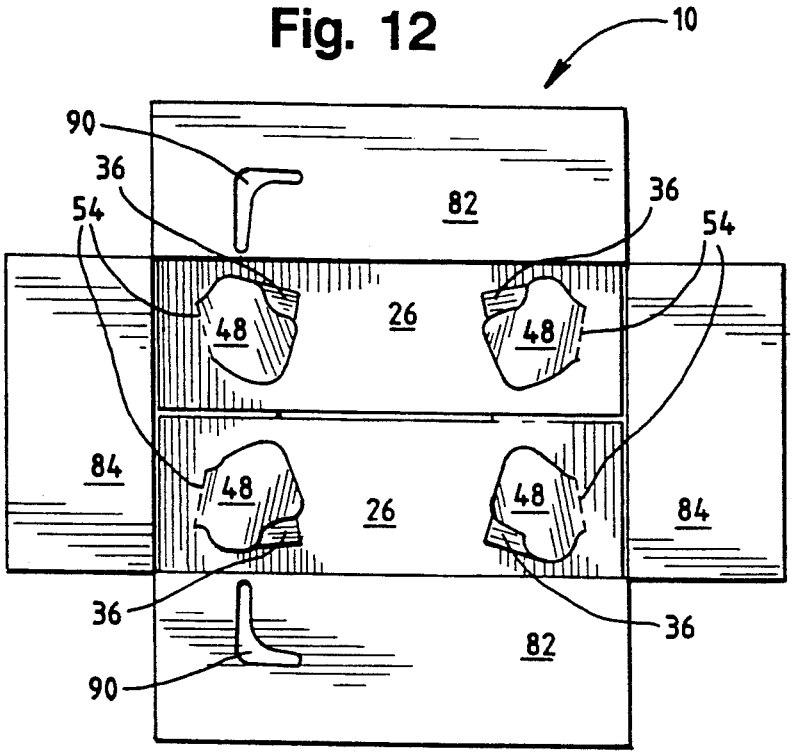
FIG. 12 is a non-inverted plan view of the inside of the assembled carton in FIG. 6 with top flaps.

Projecting tab 50, straight segment 58 and hinge 54 provide several important attributes to locking device 46. Projecting tab 50 overlies locking tab 36 when corresponding ends of an end flap 22 and side flap 26 are interlocked, as illustrated in the left side of FIG. 6, and prevents locking tab 36 from being inadvertently disengaged from side flap 26. Projecting tab 50 also provides a sloping ramp for the outer edge **30*a* of locking tab 36 when locking tab 36 moves toward ear 48 just prior to the locking engagement of end and side flaps. Straight segment 58 adds strength to the self-locking bottom closure by abutting outer edge 32 of end flap 22, as illustrated in the right side of FIG. 6. Hinge 54 prevents ear 48 from separating entirely from side flap 26 thereby protecting locking tab 36 from being inadvertently disengaged by the contents of carton 10, as illustrated in FIG. 12. These features of the present invention are described later, in more detail, with reference to FIGS. 4–6**.

Other configurations of segments 56, 58 and 60 are possible. For example, the convex and concave portions **56*a* and 56*b* of s-shaped segment 56 could be squared off, or segments 58 and 60 could run substantially straight back to hinge line 54 from the s-shaped segment 56 so long as a somewhat U-shaped area is formed where segment 56 meets segment 58 to permit locking tab 36 to pass through the opening created in side flap 26. An important feature of locking devices 46 is the interlocking relationship between projecting tabs 50 and locking tabs 36, as explained in detail with reference to FIGS. 5 and 6. Another important feature of the locking devices is the ramp effect provided by projecting tabs 50, which is explained in detail with reference to FIG. 4B**. Modifications which maintain these features would be in accordance with the present invention.

To form the self-locking bottom closure of carton 10, sidewalls 12 (and end walls 14) are placed in opposed position with the bottom flaps 22 and 26 inverted to be right side up. Then, side flaps 26 are folded toward a common plane which is substantially perpendicular to the sidewalls and end walls of carton 10, as shown in FIG. 1. Next, end flaps 22 are folded towards the same common plane as shown in FIG. 4A such that they overlie side flaps 26. The portions of locking devices 46 which are covered by end flaps 22 are shown by phantom lines in FIGS. 4A and 4B.

Figure 4B:
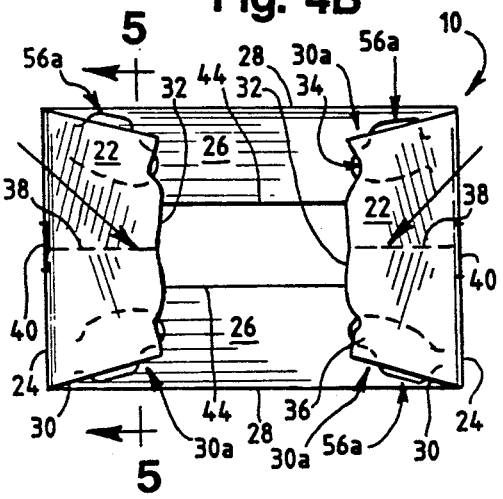
FIG. 4B is the same view of the carton in FIG. 4A, illustrating assembly of the self-locking bottom closure after force has been applied downwardly against the end flaps but before locking tabs have engaged the locking devices.

Downward force is then applied to end flaps 22 along fold lines 38 to rotate the end flaps 22 toward the interior of carton 10, as illustrated by the arrows in FIG. 4B. As each end flap 22 is forced downwardly against the side flaps 26, the side edges **30*a* of locking tabs 36 on the end flaps 22 contact the surface of side flaps 26. Fold lines 38 facilitate the proper placement and movement of side edges 30*a*, as explained later in more detail. As the end flaps 22 continue to rotate downwardly, the side edges 30*a* of locking tabs 36 push the side flaps 26 towards the sidewalls 12 and the side edges 30*a* slide downwardly along the increasingly sloped side flaps 26 towards the ears 48 of the locking devices 46. As side edges 30*a* continue sliding downwardly, portions of the side edges of the end flaps (not part of the locking tabs) make contact with and slide along the ears 48 without causing the ears 48 to separate from the side flaps 26. Simultaneously, side edges 30*a* continue to slide down the corresponding projecting tabs 50 which prevent the locking tabs 36 from pushing against the ears 48 until side edges 30*a* slide past the projecting tabs 50. As the side edges 30*a* slide past the projecting tabs 50, the locking tabs 36 push ears 48 away from side flaps 26 and towards the interior of carton to form openings 66 (shown in FIG. 1) in side flaps 26. Locking tabs 36 immediately move into and through openings 66. Once this occurs, downward force on end flaps 22 can be released, thereby permitting side flaps 26 and end flaps 22 to spring outwardly and upwardly until projecting tabs 50 abut the outer surface of locking tabs 36. At this point, locking tabs 36 are subjacent projecting tabs 50, forming a self-locking bottom closure of end flaps 22 and side flaps 26**.

There are at least two methods for locking end flaps 22 to side flaps 26. Both end flaps 22 simultaneously may be folded inwardly to engage the locking devices 46 of side flaps 26, as described above. Alternatively, each end flap 22 individually may be folded inwardly to engage the locking devices 46 of side flaps 26. Fold lines 38 and slits 40 facilitate the simultaneous folding of end flaps 22, as discussed in more detail with reference to FIGS. 4B and 5. The integrity of the locked bottom closure of carton 10 is the same, regardless of whether end flaps 22 are folded individually or simultaneously.

FIG. 5 illustrates the relative positions of ears 48, locking tabs 36 and projecting tabs 50 immediately after the locking tabs 36 have moved into and through openings 66, but before the end flap 22 and side flaps 26 spring outwardly and upwardly to complete closure. Each locking tab 36 is positioned subjacent side flap 26, and each ear 48 is subjacent locking tab 36. Once closure is completed, as illustrated in FIG. 6, each locking tab 36 is, in turn, interlocked with projecting tab 50. This relationship strengthens the locked closure because projecting tabs 50 reinforce locking tabs 36 against the weight of items in carton 10. In addition, the shape of the projecting tabs 50 compensates for possible slippage or movement of locking tabs 36 that might tend to disengage locking tabs 36 from projecting tabs 50 and locking devices 46.

FIG. 12 shows the inside of carton 10 after the self-locking closures have been assembled and carton 10 has turned right-side-up with the self-locking closures forming the bottom of carton 10. Ears 48 now overlie locking tabs 36 and protect locking tabs 36 from the contents of carton 10. When carton 10 is filled with the desired items, the items press down on each ear 48, thereby causing the ear 48 to press the locking tabs 36 toward the inside surface of the projecting tabs 50. Ears 48 and projecting tabs 50 thus "pinch" together to hold locking tabs 36 in place.

In assembling the self-locking bottom closure of carton 10, pressure may be exerted anywhere along the outside surface of end flaps 22 in order to rotate end flaps 22 towards the inside of carton 10. Fold line 38, however, provides a convenient and preferred location for pressing on end flaps 22. When pressure is applied along fold line 38, as shown by the arrows in FIG. 4B, end flap 22 bends slightly inward at fold line 38, as shown in FIGS. 4B and 5. Slit 40 assists in the bending of end flap 22 by making fold line 38 more flexible.

This slight bending of end flaps 22 makes it easier to slide the side edges 30*a* of locking tabs 36 downwardly along the surface of side flaps 26 and ultimately against ears 48 and into and through openings 66. When an end flap 22 is bent inwardly at fold line 38, less force is required for the locking tabs 36 of the end flap 22 to engage ears 48 of side flaps 26 than if the end flap 22 were perfectly flat and rigid. Bending the end flaps 22 at fold lines 38 essentially reduces the width of the end flaps 22 thereby bringing the side edges 30*a* of the lock tabs 36 inwardly toward the middle of end flaps 22. The inward motion of the edges 30*a* of the lock tabs 36 in turn reduces the distance between the edges 30*a* and the locking devices 46 of side flaps 26. The side edges 30*a* of the locking tabs 36 thus press against the ears 48 of the locking devices 46 sooner than if the end flaps 22 were flat and rigid. In addition, because the distance between the edges 30*a* of the locking tabs 36 and the locking devices 46 is reduced when the end flaps 22 are bent inwardly at fold line 38, the side flaps 26 do not rotate inwardly as far as they would have to rotate if the end flaps 22 were flat. Consequently, the slight bending of the end flaps 22 at fold lines 38 reduces the force and time required to interlock the locking tabs 36 and the locking devices 46. In addition, when the external downward force on end flaps 22 is released, fold lines 38 help to ensure that end flaps 22 spring upwardly and outwardly until projecting tabs 50 abut the surface of locking tabs 36.

Fold lines 38 also reduce the number of steps needed to assemble the self-locking bottom closure of carton 10. Because fold lines 38 are biased inwardly, toward the interior of carton 10, the same pressure which rotates end flaps 22 inwardly along fold lines 24 to engage locking tabs 36 with locking devices 46 also bends end flaps 22 along fold line 38. In addition, because the same inward pressure causes end flaps 22 to both rotate inwardly along fold lines 24 and bend along fold line 38, both end flaps 22 may be simultaneously rotated more easily to engage the lock tabs 36 with the locking devices 46 of side flaps 26.

Fold lines 38 also improve the strength and integrity of the locked bottom closure. Fold lines 38 bias the middle of end flaps 22 toward the inside of carton 10, thereby counteracting the pressure exerted on end flaps 22 by the contents of carton 10.

Figure 7:
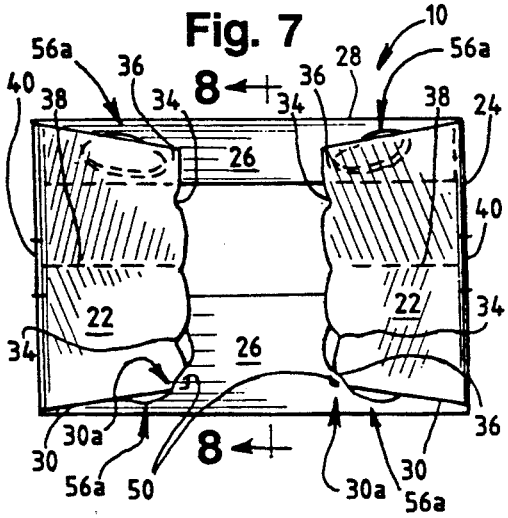
FIG. 7 is the same view of the inverted carton in FIG. 4A illustrating various stages of disassembly of the self-locking bottom closure.
Figure 8:
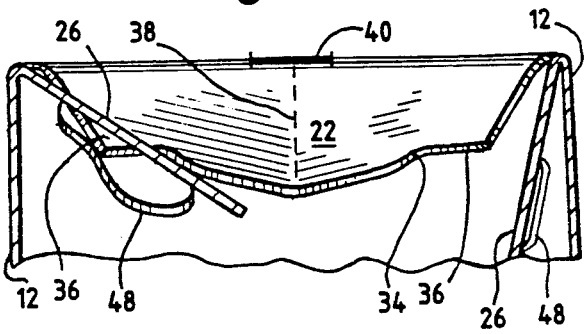
FIG. 8 is a fragmentary, cut away view along line 8—8 in FIG. 7 illustrating the position of the two side flaps and one end flap.

Referring now to FIGS. 7 and 8, the locking tabs 36 are disengaged from locking devices 46 by applying a downward force to each side flap 26. This force causes the side flaps 26 to rotate into the interior of the carton, as shown. Although it is understood that both side flaps are simultaneously rotated downwardly, FIG. 7 illustrates two different positions of the side flaps during downward rotation. As the side flap 26 rotates downwardly, the edges of projecting tabs 50 of locking devices 46 press against the locking tabs 36 of end flaps 22 and push end flaps 22 downwardly. This is illustrated at the bottom of FIG. 7 and at the left side of FIG. 8. As the downward force continues, the edges of projecting tabs 50 slide along the top surface of the locking tabs 36 towards the side edges 30*a* of locking tabs 36 to disengage tabs 36 from openings 66. When the projecting tabs 50 move past the side edges 30*a*, disengagement is completed and the locking tabs 36 as well as the end flaps 22 then spring up and come to rest in a position overlying the side flaps, as shown at the top of FIG. 7 and at the right side of FIG. 8. Downward force on side flaps 26 can then be released. Although the preferred manner described above for disengagement of the bottom closure contemplates a simultaneous, downward force on both side flaps 26, each side flap 26 may be individually pushed downwardly to disengage that side flap 26 from the two end flaps 22. When all locking tabs 36 are disengaged, side flaps 26 and end flaps 22 may be collapsed into a substantially flat configuration for storage and shipping.

Figure 9:
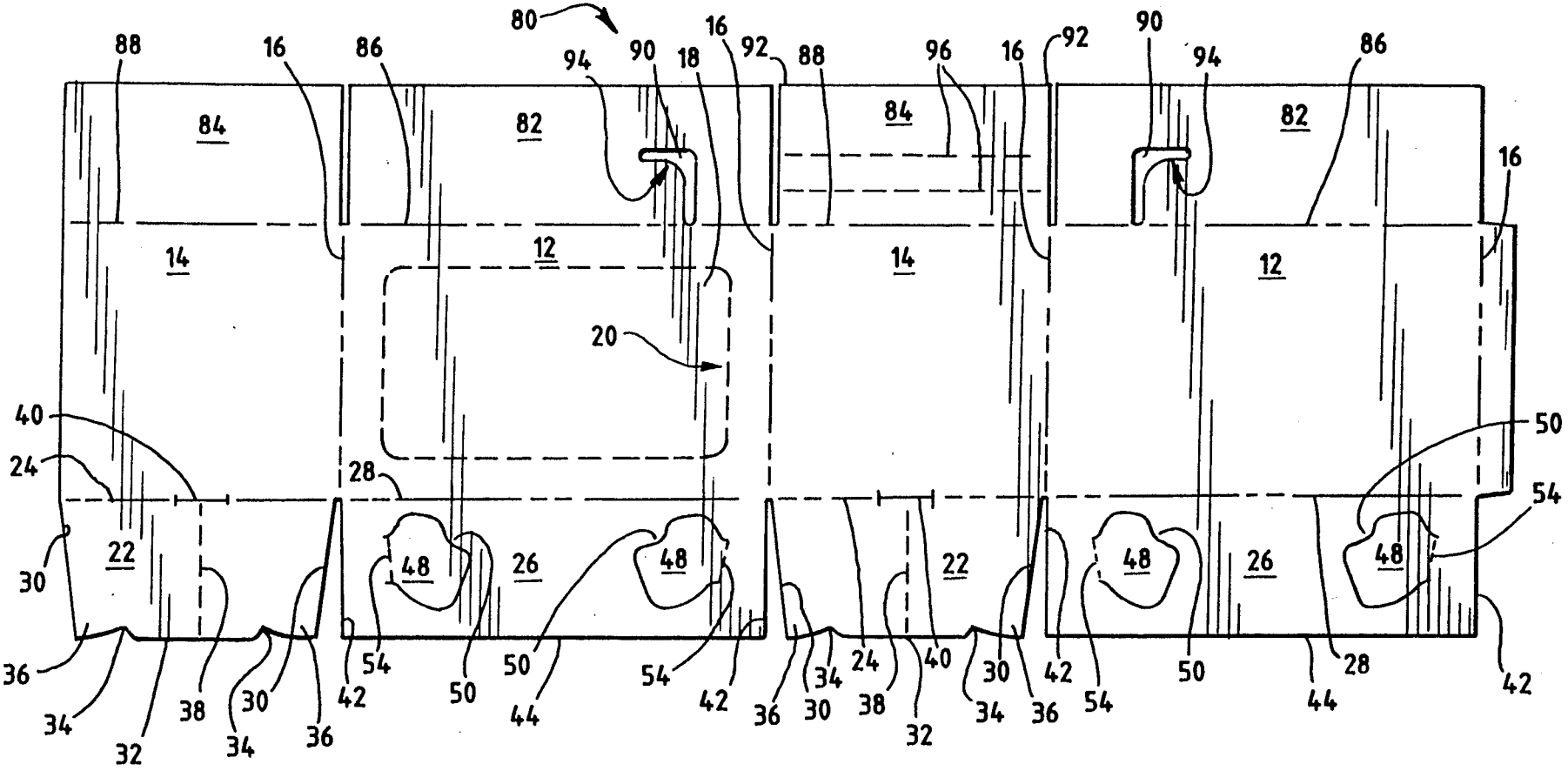
FIG. 9 is a plan view of a blank for a carton with a self-locking end closure in accordance with the present invention.

Carton 10 is formed from a blank 80, which is shown in FIG. 9. Blank 80 may be formed of a unitary piece of paperboard of suitable weight and thickness, preferably corrugated cardboard. Sidewalls 12 are arranged in an alternating relationship with end walls 14 and are hingedly coupled to end walls 14 along wall fold lines 16. Each side flap 26 is foldably attached to an adjacent sidewall 12 along a side flap fold line 28, and each end flap 22 is hingedly coupled to an adjacent end wall 14 along an end flap fold line 24.

Blank 80 may also have top side flaps 82 and top end flaps 84. Each side flap 82 is foldably attached to an adjacent sidewall 12 along a fold line 86. Each end flap 84 is hingedly coupled to an adjacent end wall 14 along a fold line 88. When carton 10 is assembled from blank 80, the side flaps 82 and the end flaps 84 are inwardly foldable to a common plane. In this folded configuration, side flaps 82 and end flaps 84 close the top of carton 10 opposite the self-locking bottom closure defined by side flaps 6 and end flaps 22.

When folded to form a top closure, each end flap 84 may be secured to side flaps 82 using conventional means, as described in the prior art. Preferably, blank 80 is provided with end flaps 84 and side flaps 82 which facilitate the re-use of carton 10. Thus, for example, blank 80 may include two open slots 90, positioned on separate side flaps 82. The two open slots 90 engage the corners 92 of the end flap 84. Slots 90 are defined by cut lines 94 and form an open area into which corners 92 are inserted. End flaps 84 may also have transverse fold lines 96 which are substantially parallel to fold lines 88 and are spaced relatively close to fold lines 88. Bending the end flap 84 outwardly along transverse fold line 96 effectively shortens the end flap 84 thereby facilitating the insertion of corners 92 into slots 90.

Figure 10:
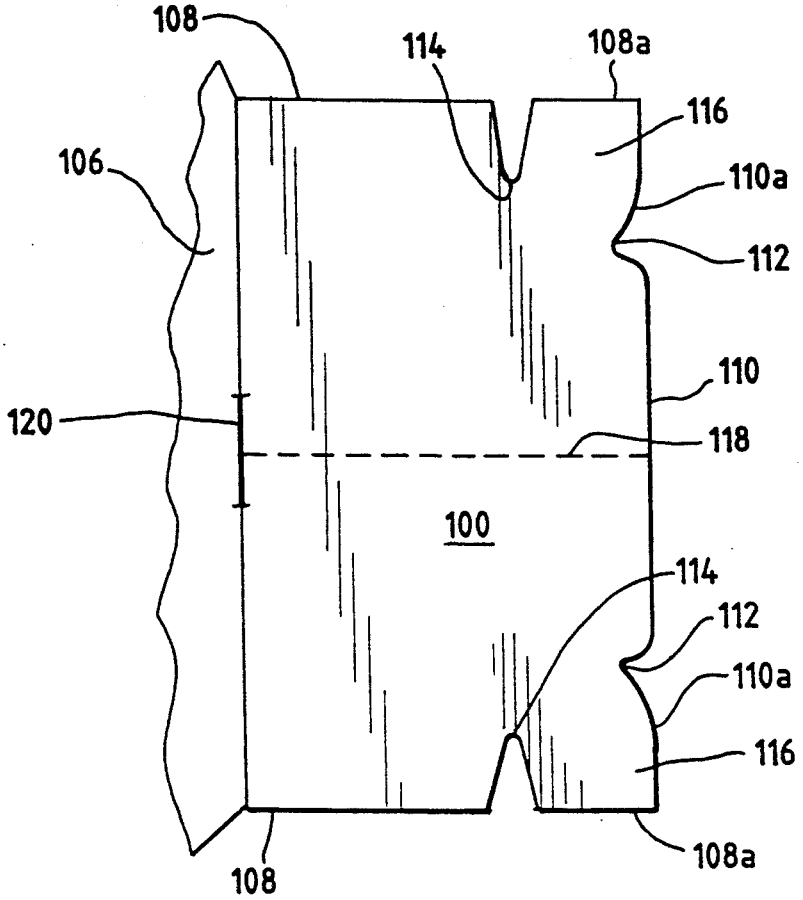
FIG. 10 is a fragmentary plan view of a second embodiment of an end flap according to the present invention.
Figure 11:
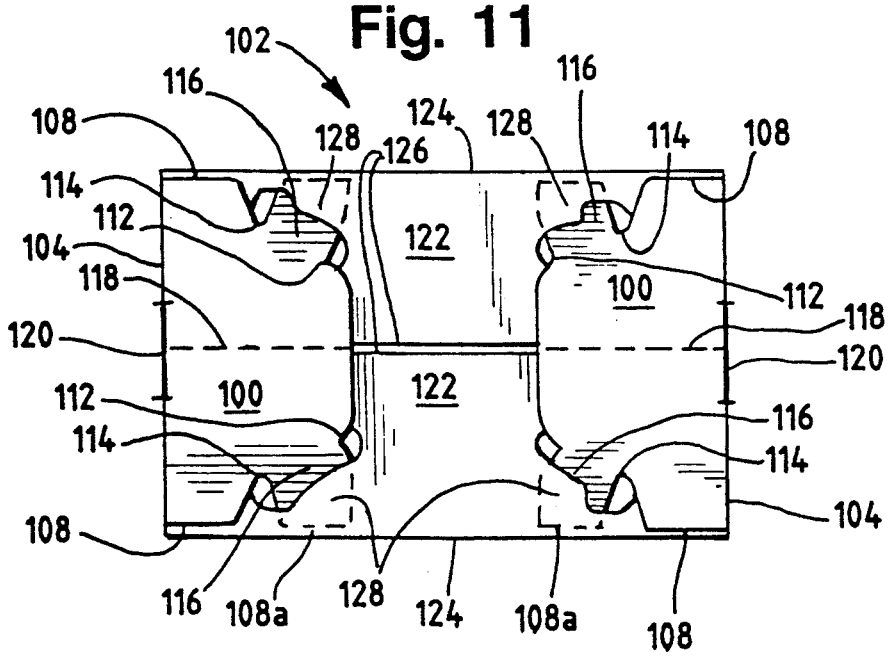
FIG. 11 is a plan view of an inverted container with the end flap in FIG. 10 illustrating the second embodiment of the present invention fully assembled.

A second embodiment of an end flap 100 according to the present invention is shown in FIG. 10. A carton 102, shown in an inverted plan view in FIG. 11, is substantially the same as carton 10, differing only in the form of end flaps 100. Each end flap 100 is hingedly joined by the fold line 104 to the adjacent end wall 106 of carton 102, as shown in FIG. 10. Each end flap 100 has essentially parallel side edges 108, and an outer edge 110 which is substantially parallel to fold line 104. Outer edge 110 is substantially the same as outer edge 32 of end flap 22 in the previously disclosed embodiment. Outer edge 110 includes a pair of mirror image notches 112 and sloped portions 110*a* which are symmetrically positioned relative to side edges 108. Sloped portions 110*a* extend between each notch 112 and the end of side edge 108. End flap 100 differs from end flap 22 in FIG. 2 primarily in the configuration of side edges 108. Side edges 108 are essentially parallel to each other and include a second pair of notches 114. Notch 112, sloped portion 110*a*, notch 114 and end portion 108*a* of the side edge 108 extending from notch 114 to outer edge 110 combine to form a locking tab 116. Notches 114 permit the proper placement of locking tabs 116 when the self-locking bottom closure of carton 102 is assembled.

Each end flap 100 may also include a fold line 118 perpendicular to and extending between outer edge 110 and fold line 104 and substantially located at the middle of end flap 100. A slit 120 may also be included along fold line 104. In a preferred embodiment, fold line 118 essentially bisects slit 120. Fold line 118 and slit 120 of end flap 100 are analogous to and provide the same functions and advantages as fold line 38 and slit 40 of end flap 22 in FIG. 2.

FIG. 11 shows carton 102 when the self-locking bottom closure is fully assembled. The portions of locking devices 116 which are subjacent the projecting tabs 128 of side flaps 122 are shown in phantom lines. Each side flap 122, foldable along fold line 124, has a pair of side edges (not shown) and an outer edge 126. Each side flap 122 also includes a pair of locking devices (not shown) symmetrically positioned as mirror images at predetermined distances from the side edges (not shown) and outer edge 126. The locking devices are substantially identical to locking devices 46 of carton 10. Only projecting tabs 128 of the locking devices are shown in FIG. 11.

The self-locking bottom closure of carton 102 is interlocked in a manner similar to carton 10. Side flaps 122 are folded toward a common plane which is substantially perpendicular to the sidewalls and end walls 106 of carton 102. End flaps 100 are then folded along fold lines 104, toward the same common plane, and forced downwardly against side flaps 122.

As end flaps 100 are forced downwardly against the side flaps 122, the side edges 108*a* of locking tabs 116 on the end flaps 100 contact the surface of side flaps 122. Fold lines 118 facilitate proper placement and movement of side edges 108*a*, as explained above in the description of the preferred embodiment. As the end flaps 100 are forced downwardly, the side edges 108*a* of locking tabs 116 push the side flaps 122 towards the sidewalls of carton 102 and the side edges 108*a* slide downwardly along the increasingly sloped side flaps 122, including protecting tabs 128, towards the ears of the locking devices. Ultimately, the side edge portions 108*a* slide past the projecting tabs 128, and the locking tabs 116 push the ears away from the side flaps 122 to form openings in the side flaps 122. Locking tabs 116 move immediately into and through the openings for engagement with the locking devices.

Because the side edges 108 of the end flaps 100 are essentially straight and do not taper inwardly, notches 114 along side edges 108 facilitate the movement of locking tabs 116 into and through the openings formed in the side flaps 122. Once they pass through the openings, the side edges 108*a* of locking tabs 116 extend almost all the way to side flap fold lines 124, as shown in FIG. 11.

Figure 13:
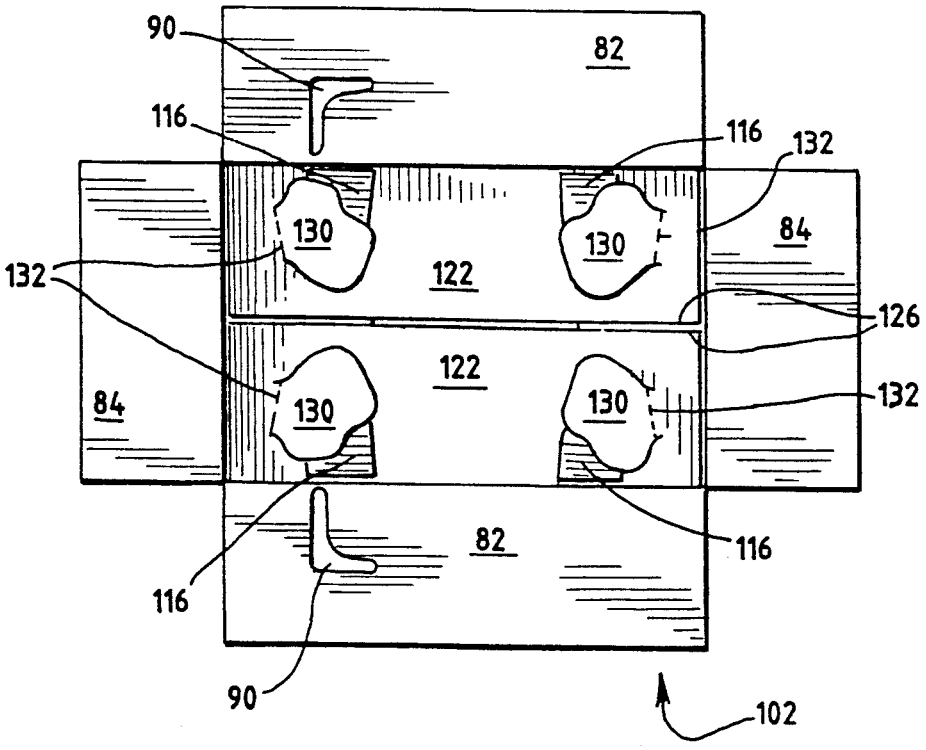
FIG. 13 is a non-inverted plan view of the inside of the assembled carton in FIG. 11 with top flaps.

FIG. 13 shows the inside of carton 102 after the self-locking closures have been assembled and carton 102 has turned right-side-up with the self-locking closures forming the bottom of carton 102. Ears 130 and hinge line 132 of the locking devices are illustrated in FIG. 13. Ears 130 overlie locking tabs 116 and protect locking tabs 116 from the contents of carton 102. When carton 102 is filled with the desired items, the items press down on each ear 130, thereby causing the ear 130 to press the locking tabs 116 toward the inside surface of the projecting tabs 128 (not shown in FIG. 13). Ears 130 and projecting tabs 128 thus "pinch" together to hold locking tabs 116 in place.

The configuration of side edges 108 and locking tabs 116 on end flaps 100 provides a strong, positive lock between end flaps 100 and side flaps 122. The bottom closure provided by end flaps 100 and side flaps 122 is especially resistive to the pressure exerted by the contents of carton 102 because locking tabs 116 extend almost to side flap fold lines 124, as shown in FIG. 13, and thus are not easily disengaged from the locking devices of side flaps 122.

Because of this strong, positive self-locking bottom closure, disengaging the locking tabs 116 from the locking devices of side flaps 122 is somewhat different from disengaging the locking tabs 36 of carton 10 (shown in FIGS. 1, 4A and B, 6, and 7). As with carton 10, a downward force is applied to each side flap 122, causing the side flaps 122 to rotate along fold lines 124 towards the interior of carton 102, and the projecting tabs 128 press against and push the locking tabs 116 downwardly. As the downward force continues, the edges of projecting tabs 128 slide along locking tabs 116 toward the side edge portions 108*a*. When the projecting tabs 128 move past the side edge portions 108*a*, the locking tabs 116 become disengaged from the side flap locking devices. However, in contrast with the projecting tabs 50 and locking tabs 36 of carton 10 (shown in FIGS. 1, 4A and B, 6, and 7), the projecting tabs 128 of carton 102 do not move past the side edges 108*a* of the locking tabs 116 until side flap 122 has been folded inwardly until it almost parallels the sidewalls of carton 102. Thus, in order to disengage the locking tabs 116, side flaps 122 must be rotated further inwardly than the side flaps 26 of carton 10. Once locking tabs 116 are disengaged from the locking devices, carton 102 can be collapsed into a substantially flat configuration for storage and shipping.

The self-locking closure created by the cooperation of locking tabs 36 and locking devices 46 of carton 10 or the cooperation of locking tabs 116 and the locking devices of carton 102 is especially adapted for use as a self-locking bottom closure. The inward biasing of fold lines 38 and 118, as well as the inward folding of end flaps 22 and of end flaps 100 require space within cartons 10 and 102 to accommodate the folding of end flaps 22 and 100. Thus, if carton 10 or carton 102 is substantially full, the contents prevent the proper folding of end flaps 22 or 100 thereby limiting the use of end flaps 22 or 100 and side flaps 26 or 122 as top closures. There may be, however, some circumstances in which cartons 10 or 102 are not substantially filled with contents. If cartons 10 or 102 are not full, the locking closure of end flaps 22 or 100 and side flaps 26 or 122 may also be used to provide a self-locking closure of the tops of cartons 10 and 102.

What is claimed is:

1. A carton with self-locking end closure, said carton comprising:

a tubular body with a pair of opposed sidewalls hingedly coupled by wall fold lines to a pair of opposed end walls;

a pair of end flaps hingedly coupled by end flap fold lines to said end walls, each of said end flaps having an outer edge, a pair of tapered side edges, each of said outer edges including a pair of symmetrically positioned sloped portions and a pair of symmetrically positioned notches, each of said sloped portions being adjacent one of said notches and adjacent one of said side edges and extending outwardly from said adjacent notch to said adjacent side edge, each of said tapered side edges including an end portion extending to said outer edge, each of said notches, adjacent sloped portions and adjacent end portions defining a locking tab;

a pair of side flaps hingedly coupled by side flap fold lines to said sidewalls, each of said side flaps having a pair of side edges, an outer edge, and a pair of locking devices symmetrically positioned at a predetermined distance from said side edges of said side flaps and from said outer edges of said side flaps, each of said locking devices being substantially opposite one of said side edges of said side flaps and including an ear flap, a cut line, a projecting tab and a hinge having a first end and a second end, said cut line defining said ear flap and said projecting tab and having a plurality of segments including a generally s-shaped first segment with a convex portion and a concave portion, a second segment and a third segment, said convex portion of said first segment extending from said first end of said hinge to said concave portion of said first segment and curving towards and then away from said side flap fold line, said concave portion curving away from said side flap fold line and then towards said opposite side edge of said side flap to define said projecting tab, said second segment extending from said concave portion of said first segment towards said outer edge of said side flap, and said third segment extending from said second segment to said second end of said hinge;

said side flaps foldable toward a common plane substantially perpendicular to said sidewalls and said end walls, said end flaps foldable towards said common plane and against said side flaps to place each of said end flaps in substantially overlying relationship with each of said side flaps and to place each of said locking tabs in substantially overlying relationship with one of said locking devices, said foldable side flaps, said folded end flaps and said tubular body substantially defining an interior of said carton, said end flaps being further foldable towards said interior of said carton so that each of said end portions of each of said side edges of each of said end flaps slides downwardly against and along said projecting tab of said underlying locking device until each of said locking tabs pushes said ear flaps of each of said locking devices inwardly toward said interior of said carton to form openings through which said locking tabs move to engage said locking devices and to lock said self-locking end closure of said carton.

2. The carton of claim 1 wherein each of said end flaps further comprises a fold line perpendicular to said outer edge of said end flaps and extending from said outer edges of said end flaps towards said end walls adjacent said end flaps.

3. The carton of claim 2 wherein said perpendicular fold lines are centrally positioned on said end flaps.

4. The carton of claim 2 wherein each of said end flaps further comprises a slit in each of said end flap fold lines, each of said slits substantially intersecting said perpendicular fold lines of said end flaps.

5. The carton of claim 3 wherein each of said end flaps further comprises a slit in each of said end flap fold lines, each of said slits substantially intersecting said perpendicular fold lines of said end flaps.

6. A carton with a self-locking end closure, said carton comprising:

a tubular body with a pair of opposite sidewalls hingedly coupled by wall fold lines to a pair of opposed end walls;

a pair of end flaps hingedly coupled by end flap fold lines to said end walls, each of said end flaps having a pair of side edges and an outer edge, each of said side edges including a side edge notch and an end portion extending between said side edge notch and said outer edge, each of said outer edges including a pair of symmetrically positioned sloped portions and a pair of symmetrically positioned notches, each of said sloped portions beings adjacent one of said outer edge notches and adjacent one of said side edge end portions and extending outwardly from said adjacent outer edge notch to said adjacent side edge end portions, each of said outer edge notches, adjacent sloped portions, adjacent end portions, and adjacent side edge notches defining a locking tab;

a pair of side flaps hingedly coupled by side flap fold lines to said sidewalls, each of said side flaps having a pair of side edges, an outer edge, and a pair of locking devices symmetrically positioned at a predetermined distance from said side edges of said side flaps and said outer edges of said side flaps, each of said locking devices being substantially opposite one of said side edges of said side flaps and including an ear flap, a cut line, a projecting tab and a hinge having a first end and a second end, said cut line defining said ear flap and said projecting tab and having a plurality of segments including a generally s-shaped first segment with a convex portion and a concave portion, a second segment and a third segment, said convex portion of said first segment extending from said first end of said hinge to said concave portion of said first segment and curving towards and then away from said side flap fold line, said concave portion curving away from said side flap fold line and then towards said opposite side edge of said side flap to define said projecting tab, said second segment extending from said concave portion of said first segment towards said outer edge of said side flap, and said third segment extending from said second segment to said second end of said hinge;

said side flaps foldable toward a common plane substantially perpendicular to said sidewalls and said end walls, said end flaps foldable towards said common plane and against said side flaps to place each of said end flaps in substantially overlying relationship with each of said side flaps and to place each of said locking tabs in substantially overlying relationship with one of said locking devices, said folded side flaps, said folded end flaps and said tubular body substantially defining an interior of said carton, said end flaps being further foldable towards said interior of said carton so that each of said end portions of each of said side edges of each of said end flaps slides downwardly against and along said projecting tab of said underlying locking device until each of said locking tabs pushes said ear flaps of each of said locking devices inwardly toward said interior of said carton to form openings through which said locking tabs move to engage said locking devices and to lock said self-locking end closure of said carton.

7. The carton of claim 6 wherein each of said end flaps further comprises a fold line perpendicular to said outer edge of said end flaps and extending from said outer edges of said end flaps towards said end walls adjacent said end flaps.

8. The carton of claim 7 wherein said perpendicular fold lines are centrally positioned on said end flaps.

9. The carton of claim 7 wherein each of said end flaps further comprises a slit in each of said end flap fold lines, each of said slits substantially intersecting said perpendicular fold lines of said end flaps.

10. The carton of claim 8 wherein each of said end flaps further comprises a slit in each of said end flap fold lines, each of said slits substantially intersecting said perpendicular fold lines of said end flaps.

11. A carton with a self-locking end closure, said carton comprising:

a tubular body with a pair of opposed sidewalls hingedly coupled by wall fold lines to a pair of opposed end walls;

a pair of end flaps hingedly coupled by end flap fold lines to said end walls, each of said end flaps being adjacent one of said end walls and having a pair of tapered side edges, an outer edge, and a fold line perpendicular to said outer edge, each of said perpendicular fold lines extending from said outer edges of said end flaps towards said adjacent end walls, each of said outer edges including a pair of symmetrically positioned sloped portions and a pair of symmetrically positioned notches, each of said sloped portions being adjacent one of said notches and adjacent one of said side edges and extending outwardly from said adjacent notch to said adjacent side edge, each of said side edges including an end portion extending to said outer edges, each of said outer edge notches, adjacent sloped portions and adjacent end portions defining a locking tab;

a pair of side flaps hingedly coupled by said flap fold lines to said sidewalls, each of said side flaps having a pair of side edges, an outer edge, and a pair of locking devices symmetrically positioned at a predetermined distance from said side edges of said side flaps and said outer edges of said side flaps, each of said locking devices being substantially opposite one of said side edges of said side flaps and including an ear flap, a cut line, a projecting tab and a hinge having a first end and a second end, said cut line defining said ear flap and said projecting tab;

said side flaps foldable toward a common plane substantially perpendicular to said sidewalls and said end walls, said end flaps foldable towards said common plane and against said side flaps to place each of said end flaps in substantially overlying relationship with each of said side flaps and to place each of said locking tabs in substantially overlying relationship with one of said locking devices, said folded side flaps, said folded end flaps and said tubular body substantially defining an interior of said carton, said end flaps being further foldable towards said interior of said carton so that each of said end portions of each of said side edges of each of said end flaps slides downwardly against and along said projecting tabs of said underlying locking devices until each of said locking tabs pushes said ear flaps of each of said locking devices inwardly toward said interior of said carton to form openings through which said locking tabs move to engage said locking devices and to lock said self-locking end closure of said carton.

12. The carton of claim 11 wherein each of said end flaps further comprises a slit in each of said end flap fold lines, each of said slits substantially intersecting said perpendicular fold lines of said end flaps.

13. The carton of claim 11 wherein each of said cut lines further comprises a plurality of segments including a generally s-shaped first segment with a convex portion and a concave portion, a second segment and a third segment, said convex portion of said first segment extending from said first end of said hinge to said concave portion of said first segment and curving towards and then away from said side flap fold line, said concave portion curving away from said side flap fold line and then towards said opposite side edge of said side flap to define said projecting tab, said second segment extending from said concave portion of said first segment towards said outer edge of said side flap, and said third segment extending from said second segment to said second end of said hinge.

14. A carton with a self-locking end closure, said carton comprising:

a tubular body with a pair of opposed sidewalls hingedly coupled by wall fold lines to a pair of opposed end walls;

a pair of end flaps hingedly coupled by end flap fold lines to said end walls, each of said end flaps being adjacent one of said end walls and having a pair of side edges, an outer edge, and a fold line perpendicular to said outer edge and extending from said outer edge towards said adjacent end wall, each of said side edges having a notch and a side edge end portion extending between said notch and said outer edge, each of said outer edges including a pair of symmetrically positioned sloped portions and a pair of symmetrically positioned notches, each of said sloped portions being adjacent one of said outer edge notches and being adjacent one of said side edge end portions and extending outwardly from said adjacent outer edge notch to said adjacent side edge end portion, each of said outer edge notches, adjacent sloped portions, adjacent end portions, and adjacent side edge notches defining a locking tab;

a pair of side flaps hingedly coupled by side flap fold lines to said sidewalls, each of said side flaps having a pair of side edges, an outer edge, and a pair of locking devices symmetrically positioned at a predetermined distance from said side edges of said side flaps and said outer edge of said side flaps, each of said locking devices being substantially opposite one of said side edges of said side flaps and including an ear flap, a cut line, a projecting tab and a hinge having a first end and a second end, said cut line defining said ear flap and said projecting tab;

said side flaps foldable toward a common plane substantially perpendicular to said sidewalls and said end walls, said end flaps foldable towards said common plane and against said side flaps to place each of said end flaps in substantially overlying relationship with each of said side flaps and to place each of said locking tabs in substantially overlying relationship with one of said locking devices, said folded side flaps, said folded end flaps, and said tubular body substantially defining an interior of said carton, said end flaps being further foldable toward said interior of said carton so that each of said end portions of each of said side edges of each of said end flaps slides downwardly against and along said projecting tabs of said underlying locking devices until each of said locking tabs pushes said ear flaps of each of said locking devices inwardly toward said interior of said carton to form openings into which said locking tabs move to engage said locking devices and to lock said self-locking end closure of said carton.

15. The carton of claim 14 wherein each of said end flaps further comprises a slit in each of said end flap fold lines, each of said slits substantially intersecting said perpendicular fold lines of said end flaps.

16. The carton of claim 14 wherein each of said cut lines further comprises a plurality of segments including a generally s-shaped first segment having a convex portion and a concave portion, a second segment and a third segment, said convex portion of said first segment extending from said first end of said hinge to said concave portion of said first segment and curving towards and then away from said side flap fold line, said concave portion curving away from the side flap fold line and then towards said opposite side edge of said side flap to define said projecting tab, said second segment extending from said concave portion of said first segment towards said outer edge of said side flap, and said third segment extending from said second segment to said second end of said hinge.

17. A carton blank for forming a carton with a self-locking end closure, said carton blank comprising:

a pair of sidewalls hingedly coupled by wall fold lines to a pair of end walls and arranged in alternating relationship with said end walls;

a pair of end flaps hingedly coupled by end flap fold lines to said end walls;

a pair of side flaps hingedly coupled by side flap fold lines to said sidewalls;

each of said end flaps including two tapered side edges and an outer edge, each of said outer edges including a pair of symmetrically positioned sloped portions and a pair of symmetrically positioned notches, each of said sloped portions being adjacent one of said notches and adjacent one of said side edges and extending outwardly from said adjacent notch to said adjacent side edge, each of said tapered side edges including an end portion extending to said outer edge, each of said notches, adjacent sloped portions and adjacent end portions defining a locking tab;

each of said side flaps including a pair of side edges, an outer edge and a pair of locking devices symmetrically positioned at a predetermined distance from said side edges of said side flaps and from said outer edges of said side flaps, each of said locking devices being substantially opposite one of said side edges of said side flaps and including an ear flap, a cut line, a projecting tab and a hinge having a first end and a second end, said cutline defining said ear flap and said projecting tab and having a plurality of segments including a generally s-shaped first segment with a convex portion and a concave portion, a second segment and a third segment, said convex portion of said first segment extending from said first end of said hinge to said concave portion of said first segment and curving towards and then away from said side flap fold line, said concave portion curving away from said side flap fold line and towards said opposite side edge of said side flap to define said projecting tab, said second segment extending from said concave portion of said first segment towards said outer edge of said side flap, and said third segment extending from said second segment to said second end of said hinge;

said side flaps foldable toward a common plane substantially perpendicular to said sidewalls and said end walls, said end flaps foldable toward said common plane and against the side flaps to place each of said end flaps in substantially overlying relationship with each of said side flaps and to place each of said locking tabs in substantially overlying relationship with one of said locking devices, said folded side flaps, said folded end flaps and said tubular body substantially defining an interior of said carton, said end flaps being further foldable towards said interior of said carton so that, each of said end portions of each of said side edges of each of said end flaps slides downwardly against and along said projecting tab of said underlying locking device until each of said locking tabs pushes said ear flaps of each of said locking devices inwardly toward said interior of said carton to form openings through which said locking tabs move to engage said locking devices and to lock said self-locking end closure of said carton.

18. The blank of claim 17 wherein each of said end flaps further comprises a fold line perpendicular to said outer edge of said end flaps and extending from said outer edges of said end flaps towards said end walls adjacent said end flaps.

19. The blank of claim 18 wherein said perpendicular fold lines are centrally positioned on said end flap.

20. The blank of claim 18 wherein each of said end flaps comprises a slit in each of said end flap fold lines, each of said slits substantially intersecting said perpendicular fold lines of said end flaps.

21. The blank of claim 19 wherein each of said end flaps further comprises a slot in each of said end flap fold lines, each of said slits substantially intersecting said perpendicular fold lines of said end flaps.

22. A carton blank for forming a carton with a self-locking end closure, said carton blank comprising:

a pair of sidewalls hingedly coupled by wall fold lines to a pair of end walls arranged in alternating relationship with said end walls;

a pair of end flaps hingedly coupled by end flap fold lines to said end walls;

a pair of side flaps hingedly coupled by side flap fold lines to said sidewalls;

each of said end flaps having a pair of side edges and an outer edge, each of said side edges including a side edge notch and an end portion extending between said side edge notch and said outer edge, each of said outer edges including a pair of symmetrically positioned sloped portions and a pair of symmetrically positioned notches, each of said sloped portions being adjacent one of said outer edge notches and adjacent one of said side edge end portions and extending outwardly from said adjacent outer edge notch to said adjacent side edge end portions, each of said outer edge notches, adjacent sloped portions, adjacent end portions, and adjacent side edge notches defining a locking tab;

each of said side flaps having a pair of side edges, an outer edge, and a pair of locking devices symmetrically positioned at a predetermined distance from said side edges of said side flaps and said outer edges of said side flaps, each of said locking devices being substantially opposite one of said side edges of said side flaps and including an ear flap, a cut line, a projecting tab and a hinge having a first end and a second end, said cut line defining said ear flap and said projecting tab and having a plurality of segments including a generally s-shaped first segment having a convex portion and a concave portion, a second segment and a third segment, said convex portion of said first segment extending from said first end of said hinge to said concave portion of said first segment and curving towards and then away from said side flap fold line, said concave portion curving away from said side flap fold line and towards said opposite side edge of said side flap to define said projecting tab said second segment extending from said concave portion of said first segment towards said outer edge of said side flap, and said third segment extending from said second segment to said second end of said hinge;

said side flaps foldable toward a common plane substantially perpendicular to said sidewalls and said end walls, said end flaps foldable towards said common plane and against said side flaps to place each of said end flaps in substantially overlying relationship with each of said side flaps and to place each of said locking tabs in substantially overlying relationship with one of said locking devices, said folded side flaps, said folded end flaps and said tubular body substantially defining an interior of said carton, said end flaps being further foldable towards said interior of said carton so that each of said end portions of each of said side edges of each of said end flaps slides downwardly against and along said projecting tab of said underlying locking device until each of said locking tabs pushes said ear flaps of each of said locking devices inwardly toward said interior of said carton to form openings through which said locking tabs move to engage said locking devices and to lock said self-locking end closure of said carton.

23. The blank of claim 22 wherein each of said end flaps further comprises a fold line perpendicular to said outer edge of said end flaps and extending from said outer edges of said end flaps toward said end walls adjacent said end flaps.

24. The blank of claim 23 wherein said perpendicular fold lines are centrally positioned on said end flaps.

25. The blank of claim 23 wherein each of said end flaps further comprises a slit in each of said end flap fold lines, each of said slits substantially intersecting said perpendicular fold lines of said end flaps.

26. The blank of claim 24 wherein each of said end flaps further comprises a slit in each of said end flap fold lines, each of said slits substantially intersecting said perpendicular fold lines of said end flaps.

27. A carton blank for forming a carton with a self-locking end closure, said carton blank comprising:

a pair of sidewalls hingedly coupled by wall fold lines to a pair of end walls and arranged in alternating relationship with said end walls;

a pair of end flaps hingedly coupled by end flap fold lines to said end walls;

a pair of side flaps hingedly coupled by side flap fold lines to said sidewalls;

each of said end flaps being adjacent one of said end walls and having a pair of tapered side edges, an outer edge, and a fold line perpendicular to said outer edge, each of said perpendicular fold lines extending from said outer edges of said end flaps towards said adjacent end walls, each of said outer edges including a pair of symmetrically positioned sloped portions and a pair of symmetrically positioned notches, each of said sloped portions being adjacent one of said outer edge notches and adjacent one of said side edges and extending outwardly from said adjacent notch to said adjacent side edge, each of said side edges including an end portion extending to said outer edges, each of said notches, adjacent sloped portions and adjacent end portions defining a locking tab;

each of said side flaps having a pair of side edges, an outer edge, and a pair of locking devices symmetrically positioned at a predetermined distance from said side edges of said side flaps and said outer edges of said side flaps, each of said locking devices being substantially opposite one of said side edges of said side flaps and including an ear flap, a cut line, a projecting tab and a hinge having a first end and a second end, said cut line defining said ear flap and said projecting tab;

said side flaps foldable toward a common plane substantially perpendicular to said sidewalls and said end walls, said end flaps foldable towards said common plane and against said side flaps to place each of said end flaps in substantially overlying relationship with each of said side flaps and to place each of said locking tabs in substantially overlying relationship with one of said locking devices, and folded side flaps, said folded end flaps and said tubular body substantially defining an interior of said carton, said end flaps being further foldable towards said interior of said carton so that each of said end portions of each of said side edges of each of said end flaps slides downwardly against and along said projecting tabs of said underlying locking devices until each of said locking tbs pushes said ear flaps of each of said locking devices inwardly toward said interior of said carton to form openings through which said locking tabs move to engage said locking devices and to lock said self-locking and closure of said carton.

28. The blank of claim 27 wherein each of said end flaps further comprises a slit in each of said end flap fold lines, each of said slits substantially intersecting said perpendicular fold lines of said end flaps.

29. The blank of claim 27 wherein each of said cut lines further comprises a plurality of segments including an s-shaped first segment having a convex portion and a concave portion, a second segment and a third segment, said convex portion of said first segment extending from said first end of said hinge to said concave portion of said first segment and curving towards and then away from said side flap fold line, said concave portion curving away from said side flap fold line and then towards said opposite side edge of said side flap to define said projecting tab, said second segment extending from said concave portion of said first segment towards said outer edge of said side flap, and said third segment extending from said second segment to said second end of said hinge.

30. A carton blank for forming a carton with a self-locking end closure, said carton blank comprising:

a pair of sidewalls hingedly coupled by wall fold lines to a pair of end walls and arranged in alternating relationship with said end walls;

a pair of end flaps hingedly coupled by end flap fold lines to said end walls;

a pair of side flaps hingedly coupled by side flap fold lines to said sidewalls;

each of said end flaps being adjacent one of said end walls and having a pair of side edges, an outer edge, and a fold line perpendicular to said outer edge and extending from said outer edge towards said adjacent end wall, each of said side edges having a notch and a side edge end portion extending between said notch and said outer edge, each of said outer edges including a pair of symmetrically positioned sloped portions and a pair of symmetrically positioned notches, each of said sloped portions being adjacent one of said outer edge notches and adjacent one of said side edge end portions and extending outwardly from said adjacent outer edge notch to said adjacent side edge end portion, each of said outer edge notches, adjacent sloped portions, adjacent end portions and adjacent side edge notches defining a locking tab;

each of said side flaps having a pair of side edges, an outer edge, and a pair of locking devices symmetrically positioned at a predetermined distance from said side edges of said side flaps and said outer edge of said side flaps, each of said locking devices beings substantially opposite one of said side edges of said side flaps and including an ear flap, a cut line, a projecting tab and a hinge having a first end and a second end, said cut line defining said ear flap and said projecting tab;

said side flaps foldable toward a common plane substantially perpendicular to said sidewalls and said end walls, said end flaps foldable toward said common plane and against said side flaps to place each of said end flaps in substantially overlying relationship with each of said side flaps and to place each of said locking tabs in substantially overlying relationship with one of said locking devices, said folded side flaps, said folded end flaps and said tubular body substantially defining an interior of said carton, said end flaps being further foldable towards said interior of said carton so that each of said end portions of each of said side edges of each of said end flaps slides downwardly against and along said projecting tabs of said underlying locking devices until each of said locking tabs pushes said ear flaps of each of said locking devices inwardly toward said interior of said carton to form openings into which said locking tabs move to engage said locking devices and to lock said self-locking and closure of said carton.

31. The blank of claim 30 wherein each of said end flaps further comprises a slit in each of said end flap fold lines, each of said slits substantially intersecting said perpendicular fold lines of said end flaps.

32. The blank of claim 30 wherein each of said cut lines further comprises a plurality of segments including a generally s-shaped first segment with a convex portion and a concave portion, a second segment and a third segment, said convex portion of said first segment extending from said first end of said hinge to said concave portion of said first segment and curving towards and then away from said side flap fold line said concave portion curving away from said side flap fold line and then towards said opposite side edge of said side flap to define said projecting tab, said second segment extending from said concave portion of said first segment towards said outer edge of said side flap, and said third segment extending from said second segment to said second end of said hinge.

* * * * *

UNITED STATES PATENT AND TRADEMARK OFFICE

CERTIFICATE OF CORRECTION

PATENT NO. : 5,318,220

DATED : June 7, 1994

INVENTOR(S) : Jesse F. Gagliardo

It is certified that error appears in the above-indentified patent and that said Letters Patent is hereby corrected as shown below:

Col. 1, line 48, after "Nos" insert a period --.--.

Col. 6, line 22, after "until" insert --the--.

Col. 8, line 43, after "side flaps" delete "6" and insert therefor --26-- ; and line 64, before "fold" delete "the".

Col. 11, line 53, delete "foldable" and insert therefor --folded--.

Col. 12, line 26, delete "beings" and insert therefor --being--.

Col. 16, line 4, delete "cutline" and insert therefor --cut line--; line 50, after "flaps" insert --further--; and line 54, delete "slot" and insert therefor --slit--.

Col. 18, line 48, delete "and" and insert therefor --said--; and line 55, delete "tbs" and insert therefor --tabs--.

Col. 20, line 36, after "line" insert a comma --,--.

Signed and Sealed this

Thirteenth Day of September, 1994

*Attest:*

Bruce Lehman

BRUCE LEHMAN

*Attesting Officer*

*Commissioner of Patents and Trademarks*